US006685185B2

(12) United States Patent
Gunter

(10) Patent No.: US 6,685,185 B2
(45) Date of Patent: Feb. 3, 2004

(54) STORAGE DRUM IN TURNING DEVICES OF SHEET-FED PRINTING MACHINES

(75) Inventor: Peter Gunter, Radebeul (DE)

(73) Assignee: Koenig & Bauer AG, Würzburg (DE)

( * ) Notice: Subject to any disclaimer, the term of this patent is extended or adjusted under 35 U.S.C. 154(b) by 0 days.

(21) Appl. No.: 10/141,511

(22) Filed: May 8, 2002

(65) Prior Publication Data

US 2002/0190462 A1 Dec. 19, 2002

(30) Foreign Application Priority Data

May 8, 2001 (DE) ..... 101 22 227

(51) Int. Cl.[7] ..... B65H 5/04
(52) U.S. Cl. ..... 271/275; 271/276; 271/277
(58) Field of Search ..... 271/275, 276, 271/277; 101/415.1, 246, 409, 410

(56) References Cited

U.S. PATENT DOCUMENTS

| | | | | | |
|---|---|---|---|---|---|
| 3,986,455 | A | * | 10/1976 | Jeschke et al. | 101/409 |
| 4,024,814 | A | * | 5/1977 | Becker | 101/410 |
| 4,026,209 | A | * | 5/1977 | Wirz et al. | 101/231 |
| 4,029,009 | A | * | 6/1977 | Kuhn et al. | 101/231 |
| 4,127,265 | A | * | 11/1978 | Wirz et al. | 271/260 |
| 4,202,268 | A | * | 5/1980 | Becker | 101/409 |
| 4,278,734 | A | * | 7/1981 | Ohta et al. | 428/432 |
| 4,343,241 | A | * | 8/1982 | Rudolph et al. | 101/231 |
| 4,900,008 | A | * | 2/1990 | Fichter et al. | 271/277 |
| 5,168,809 | A | * | 12/1992 | Becker | 101/408 |
| 5,255,604 | A | * | 10/1993 | Durr | 101/389.1 |
| 5,402,723 | A | * | 4/1995 | Friedrichs et al. | 101/415.1 |
| 5,454,312 | A | * | 10/1995 | Helmstaedter et al. | 101/230 |
| 5,456,458 | A | * | 10/1995 | Haupenthal | 271/276 |
| 6,050,683 | A | * | 4/2000 | Nuita et al. | 347/104 |
| 6,260,482 | B1 | * | 7/2001 | Halup et al. | 101/477 |
| 6,401,610 | B1 | * | 6/2002 | Becker et al. | 101/232 |
| 2001/0032561 | A1 | * | 10/2001 | Halup et al. | 101/415.1 |
| 2002/0096825 | A1 | * | 7/2002 | Hieb | 271/275 |
| 2002/0195770 | A1 | * | 12/2002 | Schumann | 271/275 |

* cited by examiner

*Primary Examiner*—Donald P. Walsh
*Assistant Examiner*—Matthew J. Kohner
(74) *Attorney, Agent, or Firm*—Goodwin Procter LLP

(57) ABSTRACT

The invention relates to a storage drum in turning drives of sheet-printing machines.

Figure 1:
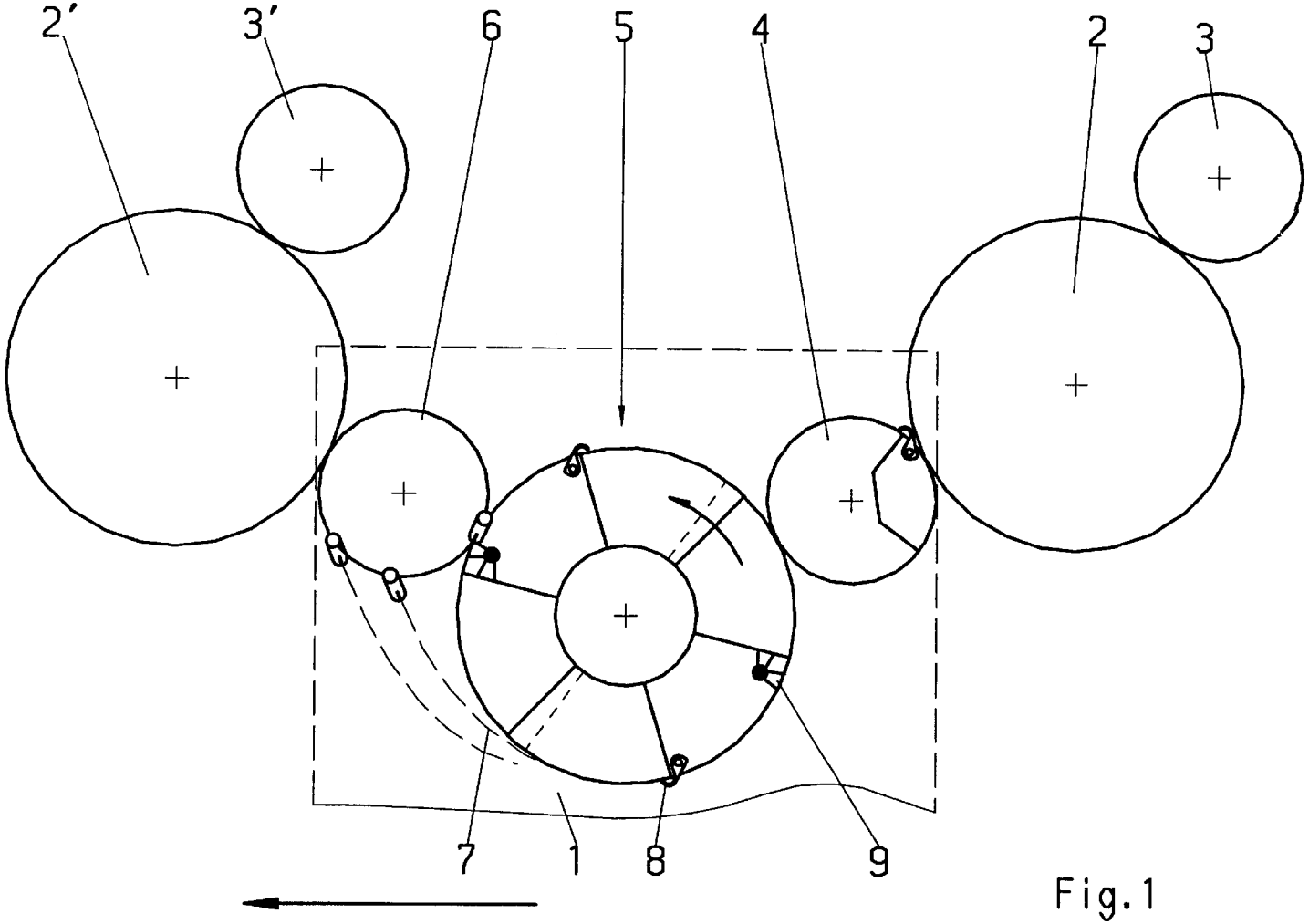

It is an object of the invention to change the relative angular position of sheet-holding positions at a storage drum in turning devices with little expense and simple means.

Pursuant to the invention, this objective is accomplished owing to the fact that sheet-holding systems (8, 9) are provided at the storage drum for taking hold of the sheets (7) in the front and rear regions, the sheet-holding systems (8, 9) can be adjusted relative to one another in the circumferential direction, the sheet-holding systems (8) for the front region of the sheet at the basic body (12) and the sheet holding systems (9) for the rear region of the sheet is assigned to a central axis (13), which is taken up by the basic body (12) and the sheet-holding systems (8, 9) are connected to one another by a clutch (18, 20), which can be released by means of the oil of an oil-under-pressure connection (29, 30, 31, 32).

9 Claims, 3 Drawing Sheets

24
21
20
19
32
17
18
31
25
35
30
29
34
15
16
14
22
33
23
11
12
10
38
8
5
9
10
11
13
26

STORAGE DRUM IN TURNING DEVICES OF SHEET-FED PRINTING MACHINES

The invention relates to a storage drum in turning devices of sheet-fed printing machines. Turning devices, operating according to the three-drum turning principle, consist of three sheet-guiding cylinders, the middle one of which is constructed as a storage drum with a diameter, which is twice as large.

The three sheet-guiding cylinders of the turning disposed between two printing cylinders. Such a turning device enables the sheet to be turned according to the sheet rear edge turning principle and, with that, the sheet to be printed in one passed.

A sheet-guiding cylinder of normally single diameter precedes the storage drum and the turning drum with a single diameter follows it.

In each case, the storage drum has two sheet holding systems for the front and to rear regions of the sheet. The sheet holding systems for the front region and the sheet holding systems for the rear region are diametrically opposite to one another.

Changeover manipulations must be carried out when changing the mode of operation from recto to recto and verso printing or vice versa or when processing sheets of a different length by recto or recto and verso printing. For adjusting the sheet holding systems for processing sheets of different length, it is necessary to adjust the sheet holding systems for the front and rear regions relative to one another The publication DE 39 116 30 C2 discloses an arrangement of sheet-holding systems at a storage drum. The sheet-holding system for the front region of the sheet, which is constructed as a clamping gripper, is permanently disposed at the body of the storage drum. The sheet-holding system for the rear region of the sheet, constructed as a suction device, is provided at a supporting element, which is disposed detachably at the body of the storage drum.

The supporting element and, with that, the suction device provided at the supporting element can be adjusted in the circumferential direction by means of an adjusting shaft, which is mounted in the drum shaft. A motor for actuating the adjusting shaft is disposed over a gear wheel step at one end of the adjusting shaft (on the outside) and a pinion is disposed at the other. The pinion engages a toothed segment, which is connected with the supporting element. The adjusting shaft is mounted eccentrically in the drum shaft.

If it is necessary to adjust the sheet-holding systems relative to one another in the circumferential direction of the storage drum, the adjusting shaft, which acts over the pinion and the toothed segment on the supporting element, is rotated by means of the motor and the gear wheel step. The suction devices are shifted with the supporting element relative to the clamping gripper.

The large expenditure for parts is a disadvantage of such an adjusting device of the sheet-holding systems. Many gearing elements engage one another with clearance, so that the adjustment of the sheet-holding systems to the dimensions of the sheet, which is to the processed, is inaccurate. The drilling and milling in the drum shaft leads to a weakness in the drum leg.

The DE 39 008 18 C1 shows a sheet-guiding drum with an inner shaft and an outer drum with at least one segment, which can be adjusted in the circumferential direction with respect to the inner shaft. The sheet-holding systems are assigned to the inner shaft and the outer drum, which are coupled together by means of a multiple-plate coupling.

The clutch is between an end surface of the segments and a journal pin of the shaft. The clutch can be actuated over a tie rod and a clamping lever, which can be actuated from the outside and, with that, the connection between the shaft and the segment can be undone. After that, both can be adjusted relative to one another with the sheet-holding systems.

The large expenditure for parts is a disadvantage of this fixing and loosening device. Access to the clutch within the bearing of the sheet-guiding cylinder for maintenance work in the event of wear and contamination is difficult. In this case also, the drilling and milling leads to a weakness in the leg.

Starting out from this state of the art, it is an object of the invention to change the relative angular position of the sheet-holding systems to one another at a storage drum in turning devices with little expenditure and simple means.

Pursuant to the invention, this objective is accomplished by the distinguishing features as claimed.

The inventive solution has the advantage that, with little expenditure for the recto printing or for the recto and verso printing, the sheet-holding systems on a storage drum can be adjusted relative to one another in the circumferential direction and locked once again. This is made possible by a clutch, which lies outside of the storage drum.

An oil-under-pressure connection, which can be used in an advantageous manner for the phase shift in the case of a change in the mode of operation or when processing a different format in recto and verso printing, is used to undo the connection of a double gear wheel.

Between the two sheet-holding systems-gripper system for the sheet in the front region and the suction system for the sheet in the rear region, there is a clutch, which can be released by an oil-under-pressure connection by pressing oil into the press fit, after which the sheet-holding systems can be shifted relative to one another.

Figure 2:
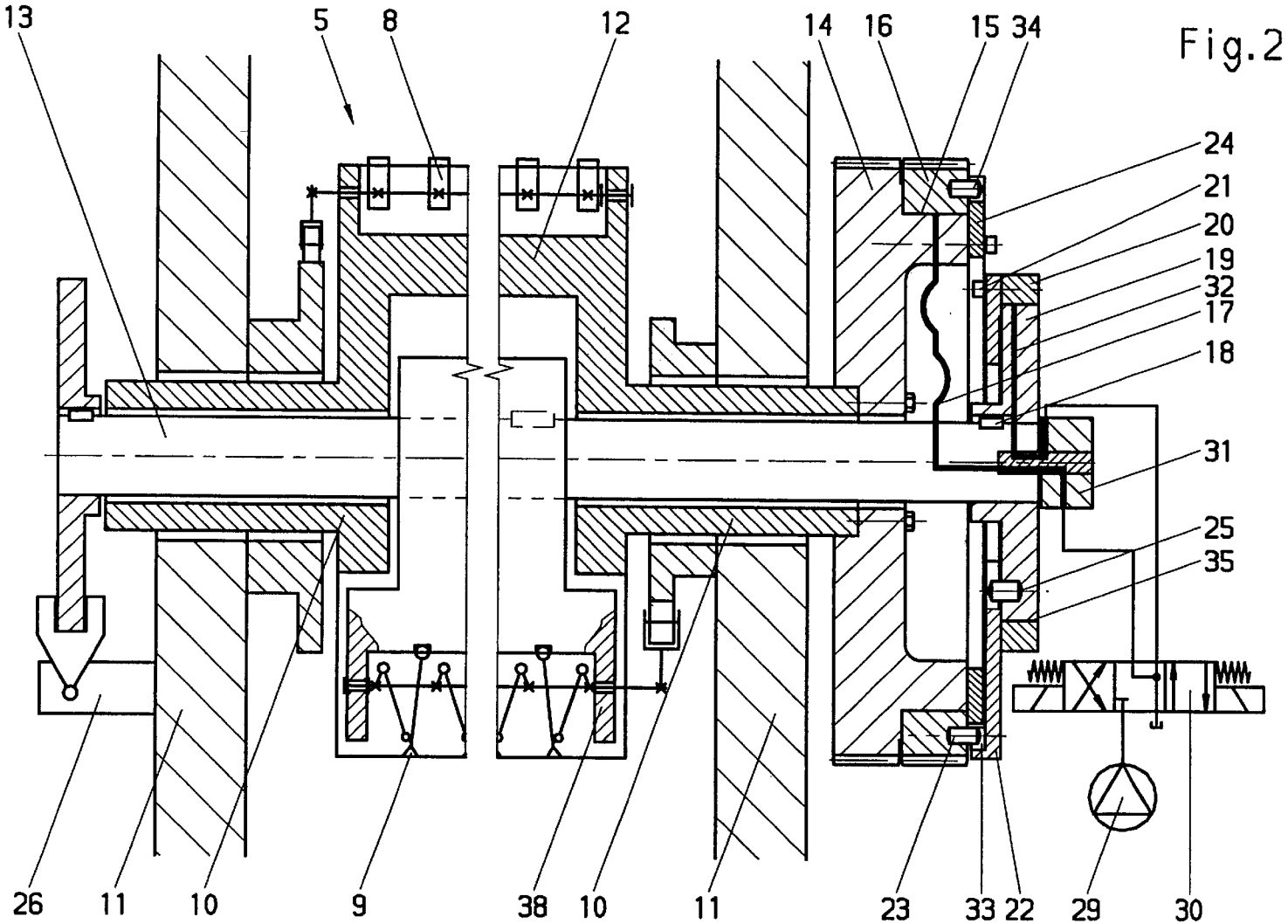
Figure 3:
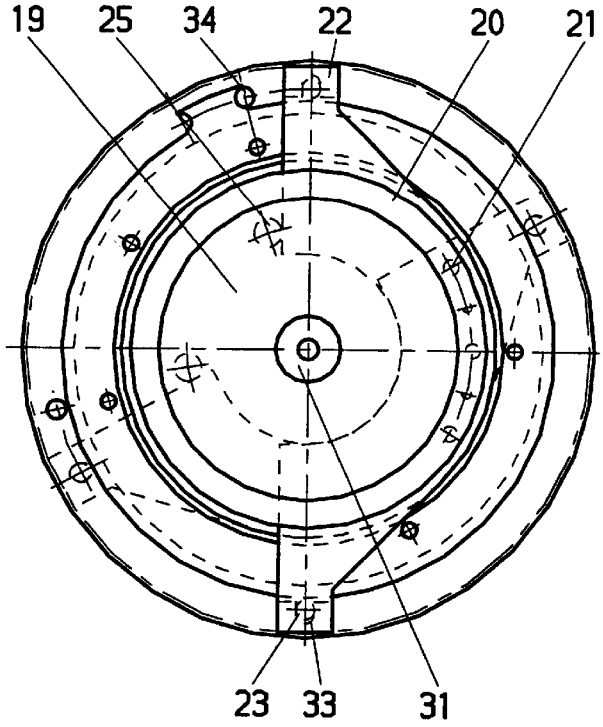
Figure 4:
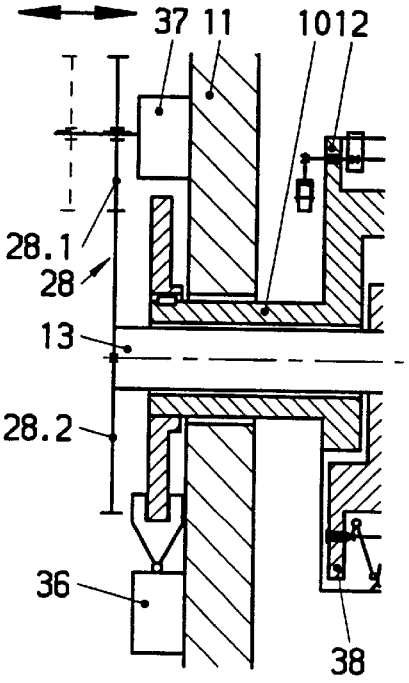

The invention is to be described in greater detail in the following by means of an example. In the associative drawings, FIG. 1 diagrammatically shows a turning device for a three-drum turning in side view, FIG. 2 shows the detailed construction of a storage drum, partially in section, FIG. 3 shows a side view of the clutch of the sheet-holding systems and FIG. 4 shows a storage drum of FIG. 2 (section) with a different driving variant.

FIG. 1 shows a diagrammatical representation of a turning device 1 of a three-drum turning in a printing machine and the printing cylinders 2, 2' with the rubber cylinder and 3, which precede and follow the turning device 1.

The turning device 1, as seen in the running direction of the sheets (marked by an arrow), consists of a transfer drum 4 of single diameter, a storage drum 5 of double diameter and a turning drum 6 of single diameter. The storage drum 5 is equipped with two sheet-holding systems 8, 9 for the sheet 7. The sheet-holding systems 8 are constructed as gripper system 8 for the front region and as suction system 9 for the rear region. The gripper system 8 and the suction system 9 can be adjusted relative to one another in the circumferential direction, so that sheets of maximum to minimum format can be held in the front and rear regions on the storage drum in the recto and recto and verso modes of operation.

The printing cylinders 2; 2' have a double diameter and may, of course, also have a single diameter.

The gripper and suction systems 8, 9 are disposed diametrically opposite to one another in the storage drum 5.

The detailed construction of the storage drum 5 is shown in FIG. 2, the sheet-holding systems 8, 9 being shown only once in each case.

In the example, the basic body 12 of the storage drum 5 is mounted rotatably with its legs 10 in the two sidewalls 11. The gripper system 8 is rigidly disposed at the basic body 12. A central axis 13 is disposed rotatably in the legs 10, which have a borehole. A suction body 38, which extends over the storage drum 5, is mounted rigidly at the central axis 13. The suction system 9 is disposed at the suction body 38. A geared wheel body 14 is mounted nonrotationally on the right leg 10 (FIG. 2) of the basic body 12. The geared wheel body 14 has a bearing set 15. A gear ring 16 is shrunk onto the bearing seat 15. The geared wheel body 14 and the gear ring 16 form a double gear wheel 14, 16. The connection between the gear ring 16 and the bearing seat can be undone by an oil-under-pressure connection (29, 30, 31, 17). For this purpose, an oil-under-pressure line 17 passes through the geared wheel body 14 to the bearing seat and to the gear ring 16.

The oil-under-pressure connection is known (German patent 35 344 86). The gear ring 16 and the geared wheel body 14 in each case mesh with a gear wheel of adjacent drums 5, 6.

The basic body 12 with the gripper system 8 and the central axis 13 with the suction system 9 are connected over a clutch 19, 20, which can be released over a second oil-under-pressure connection (29, 30, 31, 32). The connection has the following construction.

A hub 19 is mounted over an adjusting spring 18 nonrotationally on the central axis 13. A clutch ring 20 is shrunk onto the hub 19, that is, the clutch ring 20 is seated in a press fit 35 on the hub 19. The clutch ring 20 is connected rigidly by means of a screw 21 with a stop plate 22. Furthermore, cylindrical pins 23, which are permanently introduced into the gear ring 16 and accommodated by a recess 33 of the stop plate 22, are assigned to the stop plate 22.

Moreover, a guide ring 24, which secures the gear ring 16 and is to limit the escape of oil when the gear ring 16 is loosened, is provided rigidly at the geared wheel body 14. The guide ring 24 has a stop surface, which functions as stop for the stop pins 34. Furthermore, stops 25, which act against the stop plate 22, are introduced in the hub 19. The stops 25 limit the changeover path from the minimum to the maximum format.

On the other side of the central axis 13, a braking device 26 is provided, with which the central axis 13 and, with that, the suction system 9 can be locked with respect to the sidewall 11 as frame.

The second oil-under-pressure connection (29, 30, 31, 32) consists of the pump 29, the directional control valve 30, the rotation initiation 31 as well as the oil-under pressure pipeline 17, which leads to the press fit 35 of the connection between the hub 19 and the clutch ring 20.

The pump 29, the directional control valve 30 and the rotation initiation 31 are also components of the oil-under-pressure connection 29, 30, 31 for undoing the connection between the gear ring 16 and the bearing seat 15.

The sheet-holding systems 8, 9 can be adjusted relative to one another by the main driving motor of the printing machine over the main wheels pull, which includes the double gearwheel 14, 16.

A different variation of the driving mechanism for rotating the sheet-holding systems 8, 9 is shown in FIG. 4. A second braking device 36, which engages the leg 10 of the basic body 12, can be seen. A motor 37, which is fastened to the sidewall 11, is connected over a gearwheel step 28, consisting of the gearwheels 28.1, 28, with the central axis 13. The gearwheel 28.1 is connected with the motor 37 and the gearwheel 28.2 is connected with the central axis 13.

If an adjustment of the sheet-holding systems 8, 9 relative to one another is necessary for recto or recto and verso printing, the braking device 26, which engages the central axis 13, is actuated to while the printing machine is stationary and, with that, the suction system 9 of the storage drum 5 is fixed with respect to the sidewall 11.

The pump 29 is now switched on and, over the directional control valve 30, the rotation initiation 31 and the oil-under-pressure pipeline 32, the connection between the hub 19 and the clutch ring 19, 20 (press fit 35) is released by the oil pressure. With the pump 29 switched on, the wheels pull and, with that, the double gearwheel 14, 16, with the suction system 9 stationary with respect to the side wall 11, the printing machine can be put through a complete revolution by the main driving mechanism, which is not shown. With that, the basic body 12 and the gripper system 8 of the storage drum 5 are rotated over the double gearwheel 14, 16. At the same time, the clutch ring 20 is rotated by the cylindrical pin 23 in the gear ring 16 and the stop plate 22 is rotated relative to the equally stationary hub 19.

The exact position of the sheet-holding systems 8, 9 relative to one another on the storage drum 5 is ascertained by an angle-measuring device (not shown).

After the nominal position of the sheet-holding systems 8, 9 is reached, the directional control valve 30 is switched and, with that, the flow of oil is interrupted, as a result of which the press fit 35 between the hub 19 and the clutch ring 20 is restored. After that, the transport of oil by the pump 29 is interrupted and the braking action of the braking device 26 is cancelled.

With that, the adjustment of the suction system 9 on the rear region of the sheet 7 is concluded.

If an additional motor 37 (FIG. 4) is present, the clutch 19, 20 is released and the gripper system 9 is fixed over the leg 10 by the second braking device 36. The gearwheel 28.1 is moved by the motor 37 from the position shown by broken lines (FIG. 4) and brought into engagement with the gearwheel 28.2. The gearwheel step 28, the central axis 13 and, with that, the suction systems 9 are moved by the motor 37 to the gripper system 8, until the specified nominal position of the sheet-holding systems 8, 9 has been assumed. The sheet holding systems 8, 9 are connected once again firmly over the clutch 19, 20 and the braking device 36 is released.

If the relative angular position of the sheet-holding systems 8, 9 must be adjusted in the recto and verso printing mode, the sheet-holding systems 8, 9 are adjusted first by adjusting the suction system 9 on the rear region of the sheet 7. The process is as described above. After that, the phase position between the storage drum 5 and the turning drum 6 is adjusted. For this purpose, the secure connection between the double gearwheel 14, 16 is undone and the angular position of the storage and turning drums 5, 6 is changed. After that, the secure connection between the double gearwheel 14, 16 is restored.

The gripper and suction system 8, 9 are present twice. It is self evident that all sheet-holding systems 8, 9 are adjusted with one changeover manipulation.

What is claimed is:

1. A storage drum in a turning device of a sheet-fed printing machine for alternately printing sheets either in recto printing mode or recto and verso printing mode, said storage drum comprising a basic body, a central axis and sheet holding systems, wherein said sheet-holding systems are provided at said storage drum for taking hold of front and rear regions of said sheets; wherein said sheet-holding systems can be adjusted relative to one another in circumferential direction; wherein said sheet-holding system for said front regions of said sheets is assigned to said basic body, and said sheet holding system for said rear regions of said sheets is assigned to said central axis, which is within said basic body, and a clutch for connecting said sheet-holding systems to one another, said connecting element can be disconnected by releasing an oil-under-pressure connection.

2. The storage drum of claim 1, wherein said sheet-holding systems comprise a gripper element and a suction element.

3. The storage drum of claim 1, wherein said clutch comprises a hub and a clutch ring, said hub being disposed non-rotationally on said central axis, said clutch ring being seated in a press fit on said hub, and a pipeline for oil under pressure leading to said press fit.

4. The storage drum of claim 1, wherein said oil-under-pressure connection comprises a pump, a directional control valve, a rotation initiation and a pipeline for oil under pressure.

5. The storage drum of claim 3, wherein said clutch ring is assigned to a gear ring over a stop plate and a cylindrical pin, said cylindrical pin being securely disposed at said gear ring.

6. The storage drum of claim 1, wherein said sheet-holding systems are adjusted relative to one another over a main wheel pull which includes a double gear wheel.

7. The storage drum of claim 2, wherein said suction system can be arrested by a first braking device engaging said central axis when said sheet-holding systems art adjusted relative to one another.

8. The storage drum of claim 1, wherein said sheet-holding systems arc adjusted relative to one another by a motor, which engages said central axis.

9. The storage drum of claim 2, wherein said gripper system can be arrested by a second braking device engaging a tubular extension when said sheet-holding systems are adjusted relative to one another.

* * * * *